United States Patent [19]

Grosser et al.

[11] 4,417,499

[45] Nov. 29, 1983

[54] WEAPON MOUNT FOR ARMORED VEHICLE

[75] Inventors: Heinrich Grosser; Hermann Dierkes, both of Vellmar; Hubertus Lütke, Lohfelden; Klaus Schreckenberg, Kassel, all of Fed. Rep. of Germany

[73] Assignee: Thyssen Industrie Aktiengesellschaft, Essen, Fed. Rep. of Germany

[21] Appl. No.: 577,210

[22] Filed: May 16, 1975

[51] Int. Cl.[3] ..... F41F 23/06

[52] U.S. Cl. ..... 89/36 K; 89/40 B

[58] Field of Search ..... 89/36 H, 36 K, 37 G, 89/37.5 R, 37.5 A, 40 B; 114/4, 5, 6, 7, 8

[56] References Cited

U.S. PATENT DOCUMENTS

| | | | |
|---|---|---|---|
| 238,698 | 3/1881 | Krupp | 89/36 K |
| 2,254,678 | 9/1941 | Frise | 89/37.5 R |
| 2,405,642 | 8/1946 | Corte | 89/37.5 A |
| 2,415,153 | 2/1947 | Trimbach et al. | 89/37.5 R |
| 2,444,246 | 6/1948 | Chase et al. | 89/37.5 A |

FOREIGN PATENT DOCUMENTS

| | | | |
|---|---|---|---|
| 1954797 | 5/1971 | Fed. Rep. of Germany | 89/36 H |
| 491187 | 1/1919 | France | 89/40 B |
| 524812 | 9/1921 | France | 89/37.5 R |
| 492957 | 9/1937 | United Kingdom | 89/37.5 A |

*Primary Examiner*—Stephen C. Bentley

*Attorney, Agent, or Firm*—Spencer & Frank

[57] ABSTRACT

A weapon mount for a weapon on an armored vehicle, wherein the weapon is mounted above the roof of the vehicle and the weapon is adjustable both as regards azimuth and elevation, and has a symmetrically arranged magazine. The weapon mount is provided with trunnion arms which engage the trunnion of the weapon, is connected to the rotatable inner race of a bearing disposed in the vehicle roof which bearing supports the turret roof and provides the azimuth alignment, and is supported with its lower one-piece end in a support bearing disposed at the floor of the vehicle. The support bearing is arranged coaxially with the azimuth bearing in the vehicle roof and the section of the weapon mount which is disposed in the vehicle between the two superposed bearings is non coaxial with the bearing and generates a surface of revolution when the mount is rotated about the bearing axis, i.e., the section of the bearing mount either has an oblique longitudinal axis or has a bend in it.

11 Claims, 7 Drawing Figures

WEAPON MOUNT FOR ARMORED VEHICLE

BACKGROUND OF THE INVENTION

The present invention relates to a mount for a weapon disposed above the roof of an armored vehicle and supported thereby, the weapon being adjustable as to its azimuth and its elevation and having a magazine symmetrically fastened thereto.

It is known for an armored vehicle with a tubular weapon to mount such a weapon in a fork by means of trunnions extending from both sides of the weapon so that the weapon will be adjustable as to elevation and to rotatably dispose the fork in a bearing within the vehicle roof so that the weapon will be rotatable about the azimuth axis, see for example, German Pat. No. 1,131,121. Aside from the fact that in this case the ammunition is inside the vehicle, the recoil force produced during firing is transmitted via the bearings to the vehicle roof. The recoil force causes the mount which is held in the vehicle roof, which roof has relatively little stiffness, to perform a tilting movement which has an adverse effect on the target accuracy.

It is therefore further known for an armored vehicle where the tubular weapon is attached outside the closed vehicle structure to place the fork-type mount serving to perform the elevational adjustment movement on a pivot pin which is rotatable about the azimuth axis, this pivot pin penetrating the vehicle superstructure over its entire height and being mounted in the vehicle roof as well as in the bottom of the vehicle, see for example, German Pat. No. 977,790. The drawback of this arrangement is that the weapon is inserted into an upwardly open U-shaped recess in the vehicle superstructure and can thus be adjusted as to its azimuth only to a very limited degree. Moreover, the pivot pin which passes vertically through the vehicle superstructure prevents space-saving accommodation of the crew. And with this type of structure the ammunition is accommodated next to or below the weapon in the closed vehicle superstructure.

It is further known for such weapon arrangements to design the fork-type mount to be adjustable in height together with the barrel of the weapon and to provide a drum-type magazine for the weapon (see German Pat. No. 1,186,368). The fork-type mount in this type of arrangement is guided in a tubular stud which is centrically mounted in a housing which is rotatable in the vehicle superstructure. This design has the drawback that two large-diameter roller bearings are required for the pivoting movement about the azimuth axis so that the arrangement becomes expensive. Furthermore, twisting of the vehicle superstructure during travel over uneven terrain can cause the two bearings to jam so that pivoting and thus accurate aligning of the weapon becomes more difficult, if not completely impossible. Here, too, the pivot pin passes through the rotatable housing so that space-saving accommodation of the crew is again made more difficult.

SUMMARY OF THE INVENTION

It is the object of the present invention to provide an improved weapon mount of the above-mentioned type which is supported in an armored vehicle at both the top and bottom and is used for a weapon mounted on top of the vehicle roof in order to produce a particularly stable mount for the weapon on the vehicle so that the adverse effects resulting from the recoil forces are reduced to a minimum and perfect pivoting of the weapon is possible even with a twisted vehicle superstructure. Additionally, more favorable space conditions are provided for the crew.

This is accomplished according to the present invention in that the weapon mount is provided with trunnion arms at its upper end which engage the weapon trunnions and are joined at their lower end to form a one-piece lower end for the mount, is connected to the rotatable inner race of an azimuth bearing mounted within the vehicle roof and supporting the turret roof in order to perform the azimuthal alignment, and is supported at its lower, one-piece end in a support bearing mounted adjacent the floor or bottom of the vehicle. The support bearing is disposed coaxially with the azimuth bearing in the vehicle roof and the section of the weapon mount disposed in the vehicle between the two superposed bearings is non coaxial with the bearing axes and generates a surface of revolution when the mount rotates about the bearing axes. Preferably this section of the mount either has an oblique longitudinal axis or has a bend in it.

According to a further feature of the invention the weapon mount substantially comprises a box profile, i.e., a hollow rectangular cross section, and the two trunnion arms either have a V or a U shaped configuration.

A further feature of the invention is that with trunnion arms with a V-shaped configuration, the point of juncture of the arms lies in the vicinity of the azimuth bearing in the vehicle roof or slightly above the support bearing at the bottom of the vehicle.

With the U-shaped configuration the lateral extension or bar where the two arms are connected is either in the region of the azimuth bearing in the vehicle roof or somewhat above the support bearing at the bottom of the vehicle.

According to still a further feature of the invention the support bearing at the bottom of the vehicle is preferably a ball joint which is fastened on the bottom of the vehicle or is disposed slightly above the bottom, with a gap between it and the bottom, by means of traverses or laterally extending support arms which are supported against the side walls of the vehicle. The traverses can be arranged either transversely to the longitudinal direction of the vehicle or they may have an X-shaped configuration.

The weapon mount according to the present invention has the advantage that the tilting moment resulting from the recoil force during firing of the weapon, which tilting moment acts on the vehicle, is absorbed in a double shear bearing having a large base and thus provides low forces and elastic deformations.

DETAILED DESCRIPTION OF THE PREFERRED EMBODIMENTS

Figure 1:
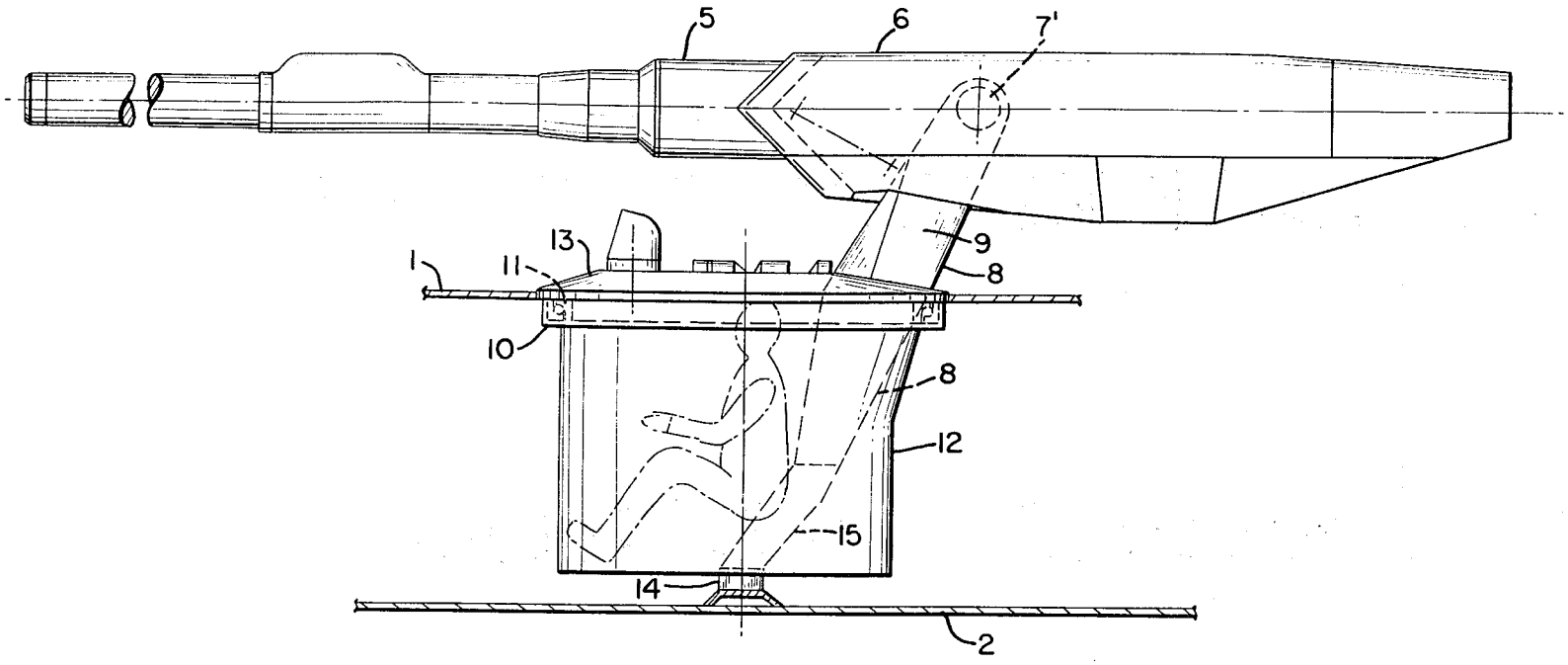
FIG. 1 is a partial sectional view of the housing of an armored vehicle with a rotatable turret and the weapon mount according to the invention in a side view, the section or portion of the weapon mount which is disposed inside the vehicle being oblique.

Referring now to FIGS. 1–5 wherein the same reference numerals refer to the same parts, there is shown only a section of the roof 1, the floor or bottom 2 and the two side walls 3 and 4 of an armored vehicle. Disposed above the roof 1 of the vehicle is a weapon 5 which has a symmetrically arranged magazine 6 and which is mounted by means of trunnions 7, 7′ extending from both sides of the weapon on the top of a mount 8. The weapon mount 8 has two arms 9,9′ at its upper end which act as trunnion arms and engage the trunnions 7 and 7′ respectively. The lower ends of the two trunnion arms 9 and 9′ are joined and the lower end of the mount 8 is formed as one piece, i.e., a single bar 15 or 15′ extending from the point of juncture of the trunnion arms to the lower end of the mount 8.

In an opening in the vehicle roof there is disposed a large diameter roller bearing 10. Connected to the inner race 11 of this roller bearing 10 for rotation therewith is a turret cradle 12 and the turret roof 13 having the sighting means for the weapon mounted thereupon. The weapon mount 8 as shown, extends through the turret roof 13 and is also connected to or in communication with the rotatable inner race 11 of the roller bearing 10 which serves to provide the azimuth alignment of the weapon 5 and turret. The lower end of the weapon mount 8 is supported in a bearing 14 which is disposed at the bottom or floor 2 of the vehicle. The two bearings 10 and 14, which, as is shown, have different diameters, are superposed on one another inside the vehicle in a coaxial manner. With this arrangement the weapon 5 is thus adjustable with respect to the azimuth by rotation about the axes of the bearings 10 and 14 and as to elevation by rotation about the axis of the trunnions 7 and 7′.

Figure 2:
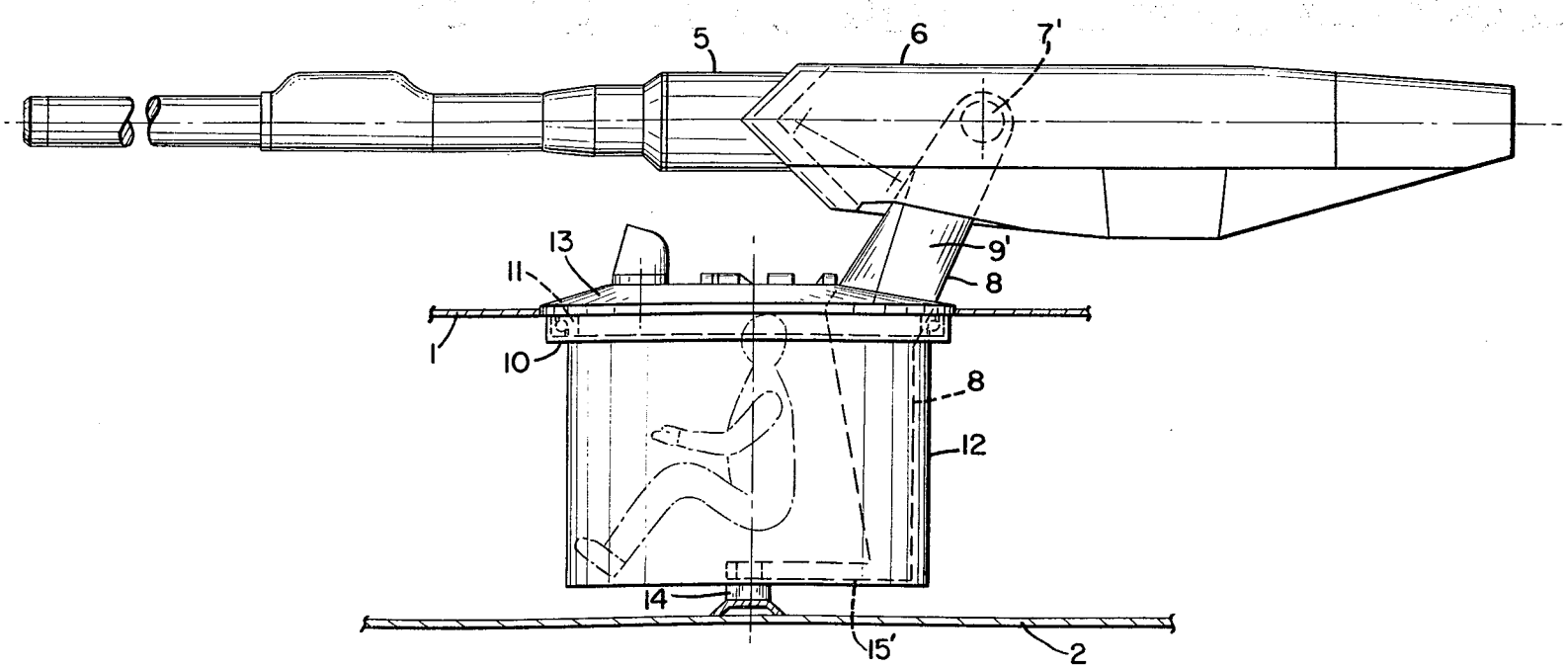
FIG. 2 is a partial sectional view similar to FIG. 1 but with a bent weapon mount section within the vehicle.

The sections or portion of the weapon mount 8 preferably have a box type profile, i.e., a hollow rectangular shape, so that lines, optical devices and the like can be passed therethrough, and the section of the mount 8 disposed between the two bearings 10 and 14 within the vehicle is not coaxial with the axes of the bearings 10 and 14 and generates a surface of revolution when movement about the azimuth axis takes place. In particular, the section of the weapon mount 8 within the vehicle between the two bearings has a configuration such that either its longitudinal axis is oblique as shown in FIG. 1 or it is provided with a bend as shown in FIG. 2.

Figure 3:
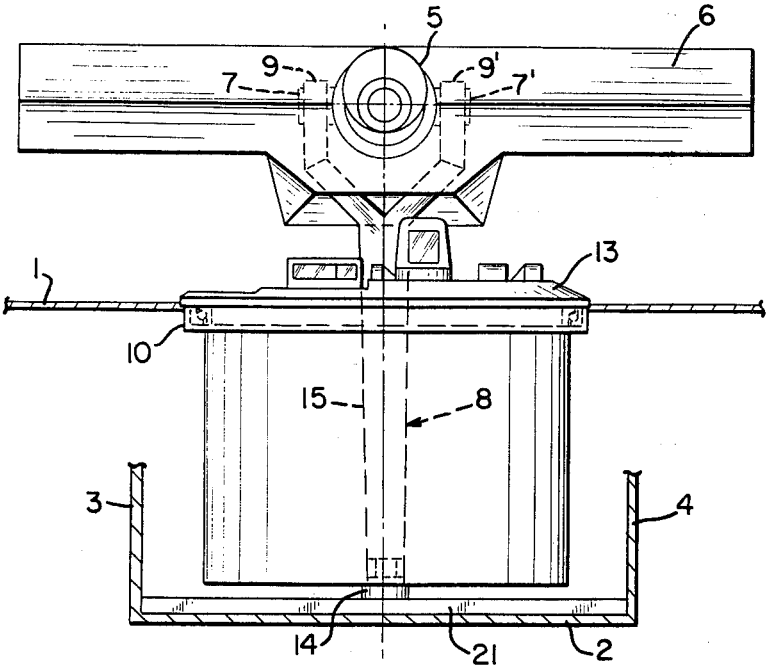
FIGS. 3–5 are frontal views of various embodiments of the weapon mount shown in FIGS. 1 and 2.
Figure 4:
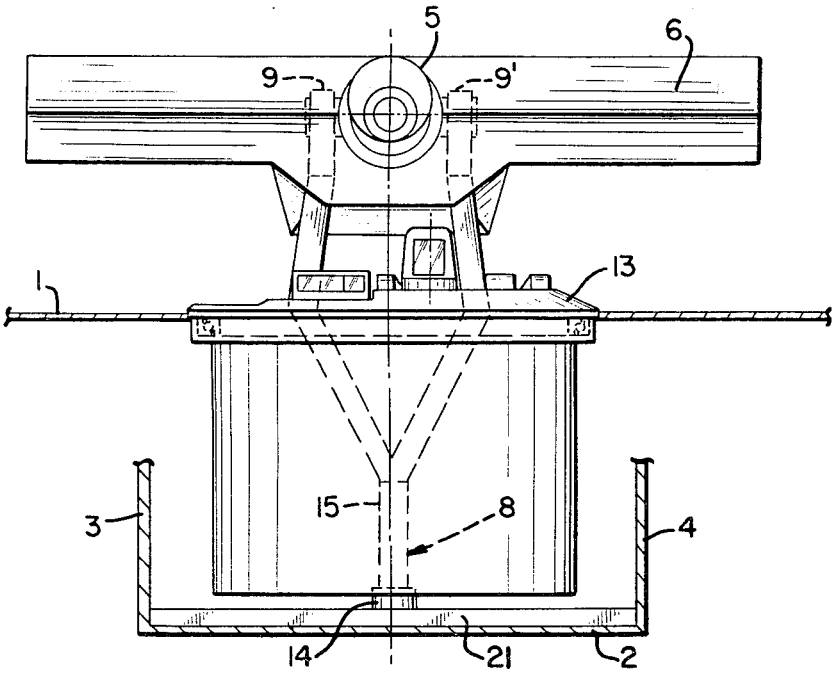
Figure 5:
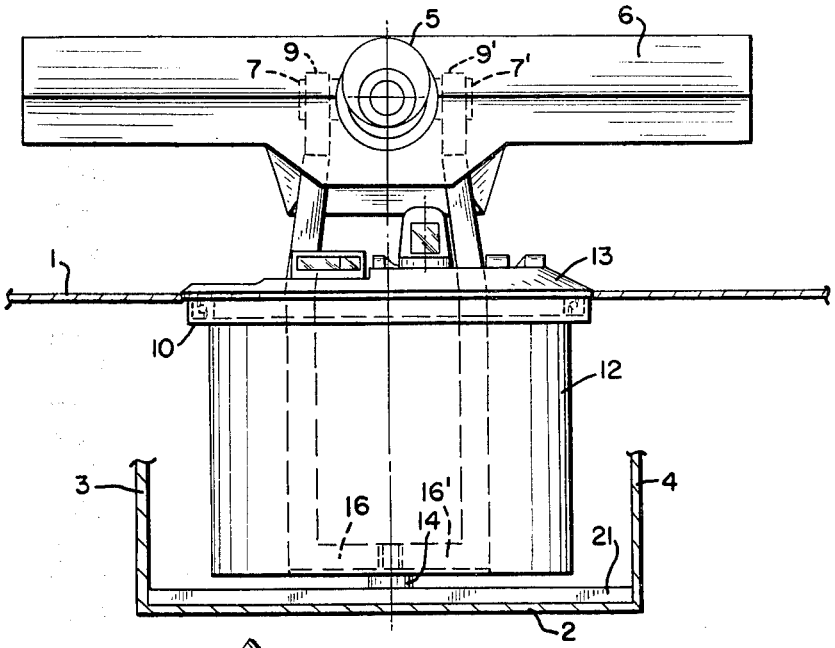

The two trunnion arms 9,9′ of the weapon mount 8 may either have a V or a U shaped configuration as shown in particular in FIGS. 3 and 5. With a V shaped configuration, the point of junction of the two arms 9,9′ may be disposed in the vicinity of bearing 10 in the vehicle roof 1 as shown in FIG. 3, wherein the trunnion arms are completely outside of the vehicle, or within the vehicle body above the support bearing 14 at the vehicle bottom 2 as shown in FIG. 4. With a U shaped configuration the laterally extending bar portions 16 and 16′ for the two arms 9,9′ are also disposed in the vicinity of the bearing 10 or somewhat above support bearing 14 as shown in FIG. 5.

Figure 6:
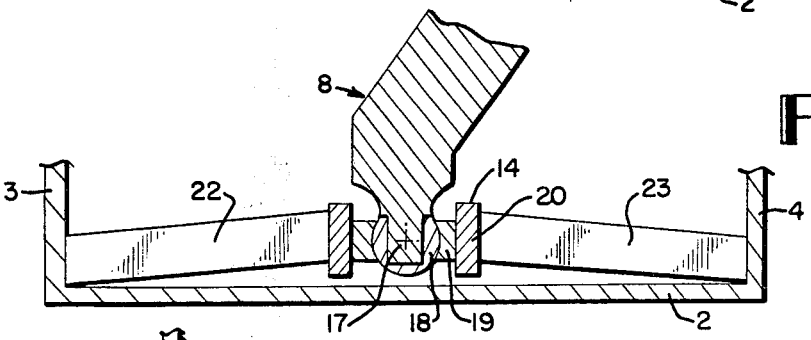
FIGS. 6 and 7 are cross-sectional and plan views respectively at an enlarged scale of the lower support bearing of the weapon mount of FIGS. 1–5.
Figure 7:
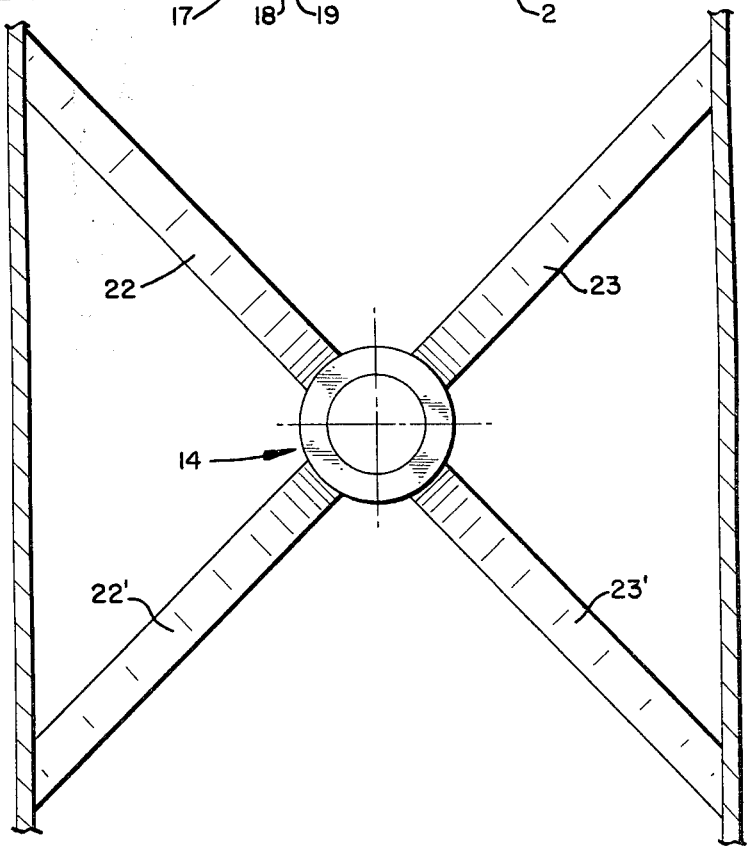

As shown in FIG. 6 the support bearing 14 disposed at the bottom or floor 2 of the vehicle is preferably a ball joint bearing. The lower end of the mount 8 is then provided with a pin 17 on which a ball race 18 is disposed which is movably disposed in a bearing cup 19, which is permanently connected with a bushing 20. The bushing 20 of bearing 14 may be permanently connected with the bottom 2 of the vehicle. Preferably, however, the bushing 20 is mounted so that it is disposed above the bottom 2, leaving a gap therebetween, by means of traverses or laterally extending support arms 21 (FIGS. 3–5), or 22,22′, 23, 23′ (FIGS. 6 and 7) which are supported by the side walls 3 and 4 of the vehicle so that the bearing 14 is better able to absorb the recoil forces of the weapon 5. The traverses are either made of one piece or consist of a plurality of sections transverse to the longitudinal direction of the vehicle (see FIGS. 3, 4 and 5) or may be arranged above the bottom 2 of the vehicle with an X shaped configuration (see FIGS. 6 and 7), respectively.

It will be understood that the above description of the present invention is susceptible to various modifications, changes and adaptations, and the same are intended to be comprehended within the meaning and range of equivalents of the appended claims.

We claim:

1. In an armored vehicle including a turret, a large diameter azimuth bearing having its outer race mounted in the roof of said vehicle and its rotatable inner race connected to and supporting the roof of said turret to provide for azimuth alignment of said turret, a weapon having a pair of trunnions extending from opposite sides thereof, and a weapon mount on said vehicle for supporting said weapon above said vehicle so that said weapon is adjustable both as regards azimuth and elevation, the improvement wherein: a support bearing which is coaxial with said azimuth bearing is disposed adjacent the floor of said vehicle; said support bearing is a ball joint bearing; means are provided for supporting said ball joint bearing a small distance above said floor of said vehicle to provide a gap therebetween, said means including a plurality of laterally extending support arms which are connected to said ball joint bearing and bear against the side walls of said vehicle; said weapon mount has a pair of trunnion arms at its upper end which engage the respective trunnions of said weapon, whereby said weapon is adjustable about the elevation axis; said trunnion arms are joined at their lower ends to form a one piece lower end for said weapon mount; said weapon mount extends through said turret roof into said turret, is connected to said rotatable inner race of said azimuth bearing for rotation therewith, and has its said lower end supported on said support bearing whereby said weapon mount is adjustable about the azimuth axis; and, the portion of said weapon mount disposed between said azimuth bearing and said support bearing is non-coaxial with the rotational axes of said bearings and generates a surface of revolution when the turret and weapon are rotated about said rotational axes.

2. Apparatus as defined in claim 1 wherein said portion of said weapon mount disposed between said azimuth bearing and said support bearing has an oblique longitudinal axis.

3. Apparatus as defined in claim 1 wherein said portion of said weapon mount disposed between said azimuth bearing and said support bearing has a bend therein.

4. Apparatus as defined in claim 1 wherein said mount substantially has a hollow rectangular cross-section and said pair of trunnion arms extend upwardly from the point of juncture in a V or a U shaped configuration.

5. Apparatus as defined in claim 4 wherein said trunnion arms have a V shaped configuration and said point of juncture is disposed in the vicinity of said azimuth bearing.

6. Apparatus as defined in claim 4 wherein said trunnion arms have a V shaped configuration and said point of juncture is disposed a short distance above said support bearing.

7. Apparatus as defined in claim 4 wherein said point of juncture is disposed in the vicinity of said azimuth bearing in said vehicle roof.

8. Apparatus as defined in claim 4 wherein said trunnion arms have a U shaped configuration and said point of juncture is disposed within said turret a short distance above said support bearing.

9. Apparatus as defined in claim 1 wherein said support arms are disposed transversely to the longitudinal direction of said vehicle.

10. Apparatus as defined in claim 1 wherein said support arms extend from said ball joint bearing in an X shaped configuration.

11. Apparatus as defined in claim 1 further comprising a symmetrically disposed magazine mounted on said weapon.

* * * * *